United States Patent [19]

Tari et al.

[11] Patent Number: 4,604,301

[45] Date of Patent: Aug. 5, 1986

[54] PROCESS FOR PREPARING DIAPHRAGM-DEPOSITED ACTIVATED CATHODES

[75] Inventors: Karl Tari, Buffalo; Tilak V. Bommaraju; Charles G. Rader, both of Grand Island, all of N.Y.

[73] Assignee: Occidental Chemical Corporation, Niagara Falls, N.Y.

[21] Appl. No.: 712,933

[22] Filed: Mar. 18, 1985

[51] Int. Cl.[4] ..... B05D 5/12; C25B 11/10

[52] U.S. Cl. ..... 427/123; 427/58; 427/377

[58] Field of Search ..... 427/58, 123, 377

[56] References Cited

U.S. PATENT DOCUMENTS 3,694,281 9/1972 Leduc ..... 428/256

*Primary Examiner*—Richard Bueker

*Attorney, Agent, or Firm*—James F. Tao; William G. Gosz

[57] ABSTRACT

A novel process for preparing a diaphragm-deposited activated cathode for use in a chlor-alkali cell is disclosed. The process involves heat-treating the activated cathode in an inert atmosphere, such as a nitrogen atmosphere, or a reducing atmosphere, such as a hydrogen atmosphere, during the baking or sintering of the diaphragm.

Diaphragm-deposited activated cathodes prepared according to this invention exhibit better adhesive and stability than those which are prepared using conventional techniques. This, in turn, permits sustained operation in a chlor-alkali cell at a lower voltage for substantial energy savings.

16 Claims, No Drawings

PROCESS FOR PREPARING DIAPHRAGM-DEPOSITED ACTIVATED CATHODES

BACKGROUND OF THE INVENTION

This invention relates to a novel process for preparing diaphragm-deposited activated cathodes to prevent exfoliation or delamination of the cathode coating from the cathode substrate.

Chlorine and caustic soda are commercially produced by the electrolysis of brine in electrochemical diaphragm cells. Such cells contain, as principle elements, a plurality of anodes, cathodes and diaphragms. The diaphragms used in such cells are deposited directly onto a foraminous cathode and thus form a single unitary structure.

The diaphragms employed in chlor-alkali cells have been traditionally fabricated from asbestos fibers. Asbestos has now been replaced to a large extent with resin-impregnated asbestos materials. In resin-impregnated diaphragms, the resin is added to a slurry of asbestos fibers and is deposited with the asbestos under vacuum onto the cathode. The diaphragm is then sintered to fuse the resin and produce a discontinuous polymer coating which joins adjacent asbestos fibers to form a resin-reinforced diaphragm. Diaphragms of this type having superior dimensional properties are disclosed in U.S. Pat. No. 3,694,281 to Leduc and U.S. Pat. No. 4,410,411 to Fenn et al.

Other, more advanced diaphragms currently being developed are fabricated completely from a synthetic polymer which can also be deposited from a slurry of polymer fibers. Diaphragms of this type are disclosed in U.S. Pat. No. 3,944,477 to Argade. These completely synthetic microporous diaphragms are more dimensionally stable and have superior voltage characteristics then the resin-impregnated diaphragms.

The foraminous cathode employed in chlor-alkali cells has been traditionally fabricated from iron or steel. Steel cathodes exhibit satisfactory voltage characteristics and are also able to withstand the operating environment of the cell which includes exposure to significant amounts of sodium chlorate and sodium hypochlorite. Efforts to improve upon the hydrogen overvoltage of steel cathodes have focused on the use of combinations of metals exhibiting lower hydrogen overvoltage characteristics than iron. These "activated cathodes" employ one or more active metals in the coating to realize low hydrogen overvoltage. Such active metals include transition metals, e.g. iron, cobalt or nickel, as well as noble metals, e.g. platinum, rhodium, ruthenium and iridium. These cathodes may also include a metal which is removable from the coating by leaching or extraction, e.g. in sodium hydroxide, to provide a high surface area. Such metals include, by way of illustration, molybdenum, zinc and aluminum.

The activated coating can be applied directly to a steel or iron substrate by means of electrodeposition, electroplating, thermal decomposition, plasma or thermal spraying, or electroless deposition. See, for instance, U.S. Pat. No. 4,354,915 to Stachurski et al., which discloses activated cathodes having an active coating of electro-deposited nickel, molybdenum and cadmium. Alternatively, a wire mesh having an active coating can be draped over a conventional steel cathode.

The combination of an activated cathode and a resin-impregnated diaphragm or a synthetic diaphragm in a narrow anode-cathode gap would produce the optimal voltage reduction in a cell and consequently offer the most economical performance. Unfortunately, however, such a diaphragm-cathode combination is not presently available on a commercial basis due, in part, to difficulties encountered in manufacturing such a structure. One of these difficulties relates to the exfoliation or delamination of the cathode coating from the substrate following baking or sintering of the diaphragm-deposited activated cathode element. This results in deterioration of the cathode coating and a pronounced increase in the hydrogen overvoltage of the cathode during prolonged usage in a chlor-alkali cell.

It is, therefore, a principal object of this invention to provide an improved process for preparing a diaphragm-deposited cathode which is not subject to delamination or large voltage increases.

SUMMARY OF THE INVENTION

In accordance with the present invention, a process is provided for preparing a diaphragm-deposited activated cathode. This process is directed to the use of a non-oxidizing atmosphere to bake or sinter the cathode after deposition of the diaphragm material. The use of a non-oxidizing atmosphere to bake or sinter the diaphragm-deposited activated cathode preserves the superior adhesion and voltage characteristics of the catalytically-active cathode coatings on iron or iron-based substrates.

DETAILED DESCRIPTION OF THE INVENTION

The process of the present invention involves, in general terms, the steps of (1) placing an activated cathode in a slurry of fibrous material, (2) depositing a uniform mixture of the fibrous material onto the cathode by means of a vacuum, (3) removing the cathode from the slurry and heating the cathode to a temperature of from about 50° C. to about 500° C. in the presence of a non-oxidizing atmosphere to bake or sinter the fibrous material, and (4) cooling the cathode to about room temperature.

More specific details of this process are found in U.S. Pat. No. 4,410,411, issued Oct. 18, 1983 to Fenn et al., the disclosure of which is incorporated herein by reference.

The fibrous material which is employed in this process can be either asbestos, resin-impregnated asbestos, or fibers of a synthetic polymer such as polytetrafluoroethylene. The use of asbestos in this process is described in U.S. Pat. Nos. 1,855,497; 1,862,444 and 1,865,152. Resin-impregnated asbestos diaphragms are described in U.S. Pat. No. 4,410,411, while diaphragms prepared from synthetic polymers such as polytetrafluoroethylene are described in U.S. Pat. No. 3,944,477. Suitable resin-impregnated asbestos diaphragms are HAPP diaphragms which are manufactured by the Occidental Chemical Corporation. The resin employed is a thermoplastic polymer, and typically a fluoropolymer such as polytetrafluoroethylene. The individual fibers can have a variety of shapes and sizes, but will generally be selected to provide a diaphragm having optimal porosity and strength characteristics. A surfactant is usually employed in the slurry to wet and disperse the fibers, and to form a uniform mixture. Wetting agents are conventional in the art and are selected on the basis of compatibility with the fibrous material.

The cathode is immersed in the fiber slurry and a vacuum is applied to the cathode chamber to coat the surfaces of the cathode. The cathode is physically a foraminous structure such as a wire mesh, perforated sheet or expanded metal. Typical cathode structures are described in U.S. Pat. No. 2,987,463. After the diaphragm is deposited the cathode is removed from the slurry and dried, leaving a diaphragm coating typically having a thickness of from about 30 to 125 mils.

The diaphragm-coated cathode is then heated to bake or sinter the fibrous material. Heat treatment is generally accomplished in an oven of sufficient size to accommodate one or more cathodes. Temperatures in the range of from about 50° C. to about 500° C. for time periods of from about ½ hour to about 10 hours are suitable. In general, the heating temperature is inversely proportional to the duration of heating.

The cathode employed in the present invention is a cathode having an active metal coating deposited onto a suitable substrate material. Suitable active metals include both transition metals, such as iron, cobalt and nickel, and noble metals such as platinum and ruthenium. A particularly desirable transition metal is nickel which can be present either as an alloy or a mixture. A metal removable from the coating by leaching or extraction can also be present in the coating. Such metals typically include molybdenum, zinc and aluminum, among others. The substrate metal is generally a conductive metal such as iron or steel. It may also be desirable to apply an intermediate layer to the substrate for additional corrosion protection. Such activated cathodes are known in the art and are described in numerous patents and publications such as U.S. Pat. No. 4,354,915, issued Oct. 19, 1982 to Stachurski et al., the disclosure of which is incorporated herein by reference.

In conventional processes for preparing diaphragm-deposited cathodes, the heating step for sintering or baking the cathode occurs in an oven in the presence of air. It has now been found that when an activated cathode is substituted for a steel cathode in this process, the presence of air in the oven has a detrimental effect on the active metal coating, resulting in exfoliation or delamination of the coating from the substrate. This effect occurs over a period of time, i.e. several weeks or more, and may not be readily discernible during the initial operation of the cathode when, in fact, the cathode may appear to exhibit good voltage characteristics. This phenomenon can be prevented by using a non-oxidizing atmosphere in the oven during the heating step. The term "non-oxidizing atmosphere", for purposes of the present invention, includes both inert atmospheres, such as nitrogen or argon, or reducing atmospheres, such as hydrogen. The presence of a non-oxidizing atmosphere produces a cathode having superior surface integrity and a longer operational life.

The following examples further illustrate the various aspects of the invention but are not intended to limit it. Various modifications can be made in the invention without departing from the spirit and scope thereof, as will be readily appreciated by those skilled in the art. Such modifications and variations are within the purview and scope of the appended claims.

EXAMPLE 1

A brine solution was electrolyzed in a pilot plant mini-cell equipped with an anode, a steel cathode and a HAPP diaphragm. The diaphragm had an asbestos loading of 0.285 lbs/ft$^2$. The diaphragm-deposited cathode was baked in a nitrogen atmosphere in an oven. The mini-cell was operated for 160 days at a current load of 600 Amps, during which time the sodium hydroxide concentration averaged 131 grams/liter. An average cell voltage of 3.11 volts at 95° C. was recorded.

EXAMPLE 2

Following the procedure of Example 1, a brine solution was electrolyzed in a pilot plant mini-cell equipped with an anode, a cathode and a HAPP diaphragm having an asbestos loading of 0.306 lbs/ft$^2$. The cathode had an active coating of nickel, molybdenum and cadmium. The diaphragm-deposited activated cathode was baked in a nitrogen atmosphere in an oven. The mini-cell was operated for 650 hours at a current load of 600 Amps; during which time the sodium hydorixde concentration averaged 122 grams/liter. An average cell voltage of 2.97 volts at 95° C. was recorded.

EXAMPLE 3

Following the procedure of Example 2, a brine solution was electrolyzed in a mini-cell equipped with an anode, a cathode having an active coating of nickel, molybdenum and cadmium, and a HAPP diaphragm having an asbestos loading of 0.252 lbs/ft$^2$. The mini-cell was operated for 1750 hours, during which time the sodium hydroxide concentration averaged 128 grams/-liter. An average cell voltage of 2.97 volts at 95° C. was recorded.

EXAMPLE 4

For purposes of comparison, the procedure of Example 1 was repeated using a steel cathode and a HAPP diaphragm having an asbestos loading of 0.252 lbs/ft$^2$. However, the diaphragm was baked in air. The mini-cell was operated for 1750 hours, during which time the sodium hydroxide concentration averaged 116 grams/-liter. An average cell voltage of 3.37 volts at 95° C. was recorded.

EXAMPLE 5

Two (2) activated cathodes were prepared for analysis and comparison purposes. Both cathodes had active coatings of nickel, molybdenum and cadmium, intermediate Watts nickel layers, and steel substrates. Resin-impregnated asbestos diaphragms (HAPP diaphragms) were deposited onto each cathode. The diaphragms had an asbestos loading of 0.322 lbs/ft$^2$. Both diaphragm-/cathode elements were substantially identical except that one element was baked in a nitrogen atmosphere, while the other element was baked in air.

Scanning Electron Micrographs were taken of cross-sections of each element using a 300× magnification. No coating degradation was observed for the element which was baked in a nitrogen atmosphere. However, significant coating degradation was observed for the element which was baked in air.

What is claimed is:

1. A process for preparing a diaphragm-deposited activated cathode comprising the steps of (a) placing an activated cathode in a slurry of fibrous material, (b) depositing a uniform mixture of said fibrous material onto the cathode by means of a vacuum, (c) removing the cathode from the slurry and heating the cathode to a temperature of from about 50° C.

to about 500°C. in an atmosphere consisting essentially of an inert gas or hydrogen to bake or sinter the fibrous material, and (d) cooling the cathode to about room temperature.

2. The process of claim 1 wherein the cathode contains a coating of an active metal.

3. The process of claim 2 wherein the active metal is applied to a ferrous metal substrate.

4. The process of claim 2 wherein the active metal is a transition metal.

5. The process of claim 4 wherein the transition metal is nickel.

6. The process of claim 2 wherein the cathode coating also contains a metal which can be removed from the coating by leaching.

7. The process of claim 6 wherein the removable metal is molybdenum.

8. The process of claim 2 wherein the active metal is a noble metal.

9. The process of claim 1 wherein the fibrous material is asbestos.

10. The process of claim 9 wherein the slurry includes a thermoplastic polymer.

11. The process of claim 10 wherein the thermoplastic polymer is a fluoropolymer.

12. The process of claim 11 wherein the fluoropolymer is polytetrafluoroethylene.

13. The process of claim 1 wherein the fibrous material is fabricated from a synthetic polymer.

14. The process of claim 13 wherein the synthetic polymer is polytetrafluoroethylene.

15. The process of claim 1 wherein the inert gas is nitrogen.

16. The process of claim 1 wherein the inert gas is argon.

* * * * *